US005982086A

United States Patent [19]

Lambert et al.

[11] Patent Number: 5,982,086

[45] Date of Patent: Nov. 9, 1999

[54] FLAT-PANEL TYPE PICTURE DISPLAY DEVICE

[75] Inventors: Nicolaas Lambert, Waalre; Gerardus G. P. Van Gorkom, Geldrop; Petrus H. F. Trompenaars, Tilburg; Siebe T. De Zwart, Valkenswaard, all of Netherlands

[73] Assignee: U.S. Philips Corporation, New York, N.Y.

[21] Appl. No.: 08/958,122

[22] Filed: Oct. 27, 1997

Related U.S. Application Data

[62] Division of application No. 08/814,449, Mar. 10, 1997, which is a continuation of application No. 08/374,752, filed as application No. PCT/IB94/00139, Jun. 6, 1994, abandoned.

[30] Foreign Application Priority Data

Jun. 8, 1993 [EP] European Pat. Off. ..... 93201631
Apr. 12, 1994 [EP] European Pat. Off. ..... 94200975

[51] Int. Cl.[6] ..... H01J 1/62; H01J 63/04; H01J 29/70

[52] U.S. Cl. ..... 313/422; 313/495; 313/496; 313/497

[58] Field of Search ..... 313/495, 496, 313/497, 422, 590, 493, 492

[56] References Cited

FOREIGN PATENT DOCUMENTS 0436997 7/1991 European Pat. Off. ..... H01J 31/12

*Primary Examiner*—Sandra O'Shea
*Assistant Examiner*—Mack Haynes
*Attorney, Agent, or Firm*—Robert J. Kraus

[57] ABSTRACT

A picture display device has a vacuum envelope and is provided with a face plate whose inner side supports a luminescent screen, a rear wall situated at a short distance therefrom, and the space in-between accommodating a plurality of electron sources, which cooperate with a plurality of electron transport duct including dielectric walls fro transporting, through vacuum, the produced electrons towards positions at a small distance from the luminescent screen. The display device further includes means for reducing the effects of undesired charge transfer of the duct walls, which are provided to improve the start-up and/or steady state electron transport conditions. Specifically, the outer sides of the duct rear walls are provided with a conductor to which an initiation potential is applied, which is equal to or higher than the potential applied for producing the electron transport field.

2 Claims, 9 Drawing Sheets

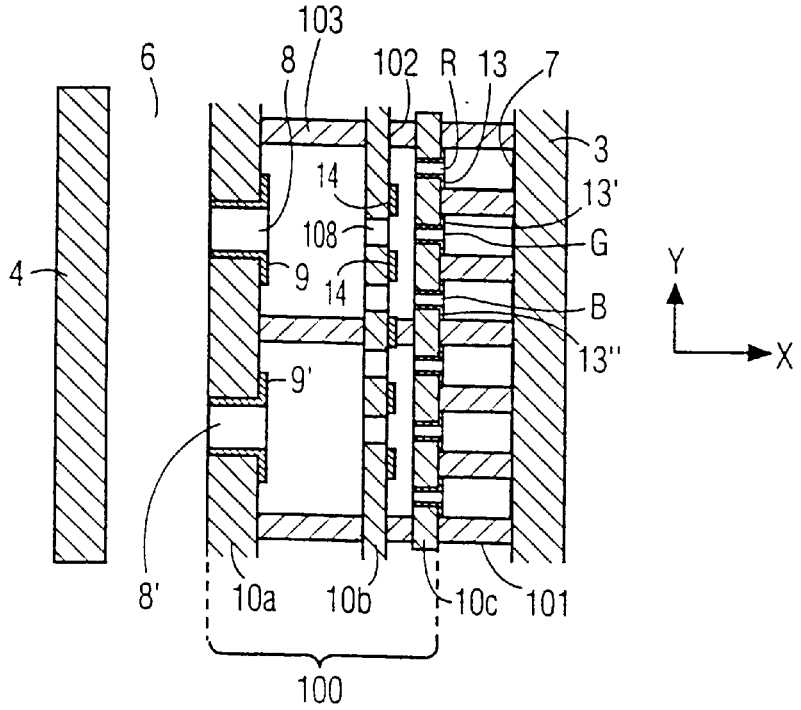
FIG. 5
FIG. 6A
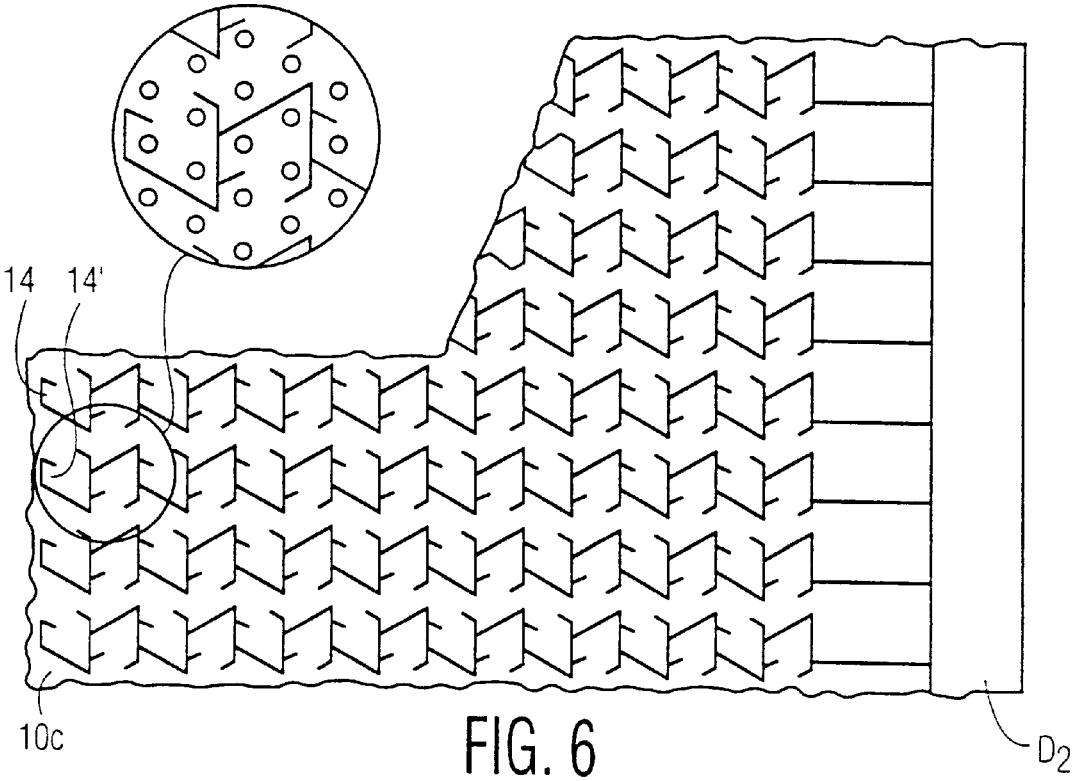
FIG. 6

FLAT-PANEL TYPE PICTURE DISPLAY DEVICE

This is a division of application Ser. No. 08/814,449, filed Mar. 10, 1997, and still pending which is a continuation of application Ser. No. 08/374,752, filed Jan. 25, 1995, now abandoned, which is a 371 Application of PCT/IB94/00139 filed Jun. 6, 1994.

BACKGROUND OF THE INVENTION

The invention relates to a picture display device having a vacuum envelope which is provided with a transparent face plate with a luminescent screen for displaying pictures composed of pixels and with a rear wall, which display device comprises a plurality of sources for emitting electrons, electron transport ducts cooperating with the sources and having walls of a dielectric material for transporting, through vacuum, emitted electrons towards positions at a short distance from the luminescent screen, and means for accelerating the electrons towards the luminescent screen.

The display device described above is of the flat-panel type, as disclosed in EP-A-436997. Display devices of the flat-panel type are devices having a transparent face plate and, arranged at a small distance therefrom, a rear plate, with the inner surface of the face plate being provided with a pattern of phosphor dots or stripes. Electrons impinging upon the luminescent screen may be controlled to form a visual image which is visible via the front side of the face plate. The face plate may be flat or, if desired, curved (for example, spherical or cylindrical).

The display device described in EP-A436997 comprises a plurality of juxtaposed sources for emitting electrons, local electron-propagation means cooperating with the sources and each constituting electron transport ducts, each having walls of a dielectric material having a secondary emission coefficient suitable for propagating emitted electrons, and an addressing system with electrodes (selection electrodes) which can be driven row by row for withdrawing electrons from the propagation means at predetermined extraction locations facing the luminescent screen, further means being provided for transporting extracted electrons towards the luminescent screen for producing an image composed of pixels.

The operation of the picture display device disclosed in EP-A-436997 is based on the recognition that electron propagation is possible when electrons impinge on a wall of a high-ohmic, substantially electrically insulating material (for example, glass or synthetic material) if an electric field of sufficient power is generated over a given length of the wall (by, for example, applying a potential difference across the ends of the wall). The impinging electrons then generate secondary electrons by wall interaction, which electrons are propagated towards a further wall section and in their turn generate secondary electrons again by wall interaction, and so forth.

Starting from the above-mentioned principle, a flat-panel picture display device can be realised by providing each one of a plurality of juxtaposed "compartments", which constitute propagation ducts, with a column of extraction apertures at a side which is to face a display screen. It will then be practical to arrange the extraction apertures along "horizontal" lines extending transversely to the ducts. By adding selection electrodes arranged in rows near to the arrangement of apertures, an addressing means is provided with which electrons can be selectively withdrawn from the "compartments" and directed towards the screen for producing a picture composed of pixels by activating respective areas of the luminescent screen.

The addressing system may be of the single-stage or of the multi-stage type.

EP-A464937 particularly describes a multi-stage addressing system. A multi-stage addressing system using a number of preselection extraction locations, which number is a fraction of the number of pixels, and associated therewith a number of (fine-)selection apertures which corresponds to the number of pixels provides advantages with respect to the extraction efficiency and/or with respect to the complexity of the connections/driving circuitry. For controlling the preselection locations, a pattern of apertured preselection electrodes is used, and for controlling the fine-selection apertures a pattern of apertured fine-selection electrodes is used.

By withdrawing electrons at desired locations from the electron ducts and directing them towards the luminescent screen, a picture can be formed on the luminescent screen. In this case it is important that the electrons in the ducts do not have excessive velocities. If electrons having too high velocities during transport through the electron ducts would enter unaddressed selection apertures and reach the screen this could lead to loss of contrast of the picture on the screen. On the other hand, in the case of too high velocities, they might not be enter (miss or bypass) an addressed selection aperture and get lost so that a selected pixel on the luminescent screen would not be excited. Too high velocities may occur due to elastic collisions with the walls (backscattering) or because electrons starting at a low velocity do not come into contact with the walls at all or do not come into contact with these walls until after they have covered a substantial distance (more than several millimeters) and gain more and more energy on their way. To prevent this, an "oblique" transport field may be applied having not only a longitudinal electric field component ($E_y$) but also a transverse electric field component ($E_x$), the latter pushing the electrons towards the non-apertured walls of the ducts. In a preferred embodiment, the electrons are pushed toward a rear wall of each duct which is opposite a front wall having the extraction apertures. It is thereby achieved that the electron current is confined to a longitudinal area proximate to the rear wall in particular. As it were, the electrons "hop" across the wall during transport, which has the envisaged effect.

A selection means is provided by providing the selection apertures with electrodes which can be energized by means of a first electric voltage so as to withdraw electron currents from the ducts via the apertures of a row, or they can be energized by means of a second "lower" electric voltage if no electrons should be locally withdrawn from the ducts. The electrons withdrawn from the ducts by this selection means can be transported towards the screen by applying an acceleration voltage. By providing a gradually, e.g. linearly, increasing potential across each rear duct wall and a similarly increasing, but lower potential across each duct wall having the extraction apertures, the field components $E_y$ and $E_x$ may be created. The rear wall potential may be defined by means of a high-ohmic resistance layer provided on the rear wall. For adjusting the rear wall potential the resistance layer is provided with electric contacts at longitudinally-spaced-apart portions of the transport duct. The potential at one contact, e.g. the contact closest to an electron-input end of the duct, should be adjusted carefully so as to obtain a uniform picture. The front wall potential can be adjusted, for example, by providing a plurality of parallel, strip-shaped electrodes on the screen side of the electron ducts, which electrodes can be given an approximately linearly increasing potential during operation. These electrodes may also be used to advantage for selecting an image line by providing apertures in these electrodes and connecting them to a circuit for providing a selection voltage.

In the display described above, suitable potentials force the electrons to "hop" along a wall. This means that each injected electron is incident on a wall and releases one secondary electron on average, which secondary electron is accelerated by the transport field, impinges upon the rear wall (or upon a side wall), and in its turn generates another secondary electron and so forth. When driven in such a mode, the number of electrons which can reach too high/excessive velocities is limited to a considerable extent.

Electrons which are withdrawn from the electron ducts can be transported towards (localized areas of) the luminescent screen by applying a sufficiently large voltage difference between the electron ducts and the screen, for example a difference of 3 kV. One image line at a time can thus be written. Video information (grey scales) can be presented, for example in the form of pulse width modulation. The distance between the extraction apertures and the screen may be very small so that the spots remain small. Electrons extracted from an individual aperture and accelerated towards the screen can be localized by providing an electron localization structure in the form of, for example, a structure of horizontal and/or vertical walls, or in the form of an apertured plate, between the extraction apertures and the luminescent screen.

In the above-described type of display, the transport mechanism appears to adjust automatically in normal operation, i.e. the wall charge on the insulating walls adapts itself. However, electron transport in a duct is sometimes unexpectedly impeded, or appears to start with difficulty, when the display is switched on, or after periods in which there has been (little or) no electron transport along a given duct location for a substantial period of time. This can adversely affect the presentation of an image on the screen.

SUMMARY OF THE INVENTION

It is an object of the invention to provide measures which lead to reliable transport conditions under different circumstances. (More particularly: the transport always starts and keeps going after the start.)

To this end a display device of the type described in the opening paragraph is characterized in that the electron transport ducts have walls located nearest to the luminescent screen which comprise electrode means for applying a potential for producing a transport field in the longitudinal direction of the ducts, and in that each transport duct comprises means for applying an initiation potential on the inner side of a wall which is located furthest remote from the luminescent screen, which initiation potential is equal to, or higher than the potential applied for producing the transport field.

The invention is based on the recognition that, as will be explained in greater detail, the problems described above occur in situations in which the wall charge deviates from the transport condition to such an extent that transport is impossible or starts with great difficulty. These situations are particularly characterized in that the rear wall of the transport duct locally has a too low (in particular: a negative) potential. By giving the rear wall potential a (substantially) higher value than the potential applied for transport, when the display is switched on, the injected electrons are automatically attracted towards the walls so that there is almost immediately an automatic correction to the transport condition.

As will be explained in greater detail, there are different embodiments for realising the inventive measure, including:

- a high-ohmic resistance layer on the inner side of the duct rear wall, while solely at an output end of the transport duct this layer has an electric contact for applying an electric voltage;
- a conductive means (start-up electrode) on the outer side of the duct rear wall.

BRIEF DESCRIPTION OF THE DRAWING

These and other aspects of the invention will be described in greater detail with reference to the drawing in which the same reference numerals are used for corresponding components.

FIG. 5 is a cross-section showing an improved implementation of a display device of the type of FIG. 1;

FIG. 6 shows diagrammatically a part of an electrode construction for the device of FIG. 5;

DESCRIPTION OF THE PREFERRED EMBODIMENTS

Figure 1:
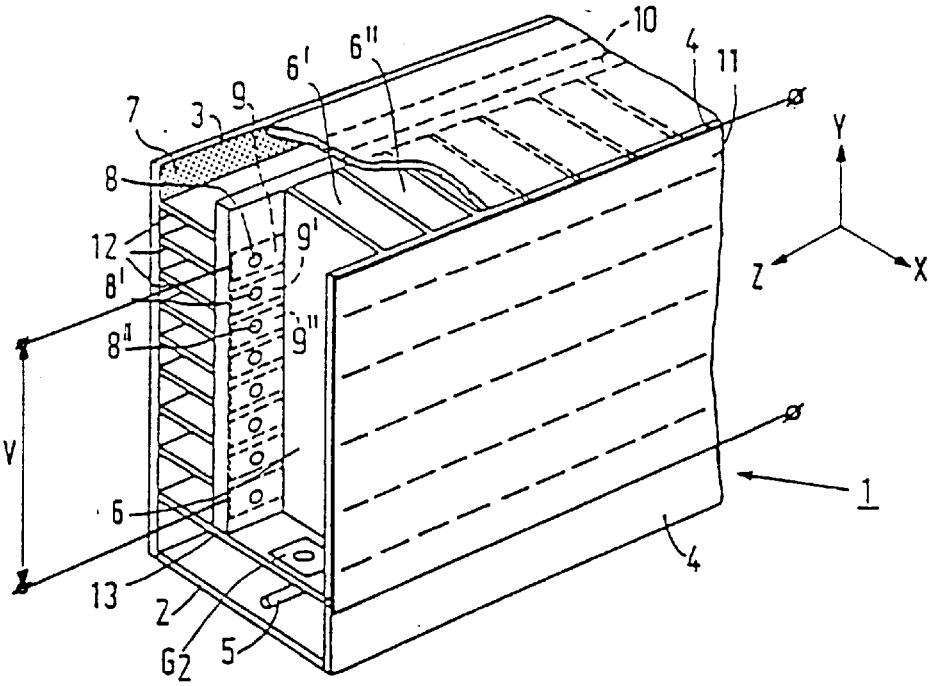
FIG. 1 is a diagrammatic perspective elevational view, partly broken away, of a part of a construction of a picture display device according to the invention whose components are not drawn to scale.
Figure 1A:
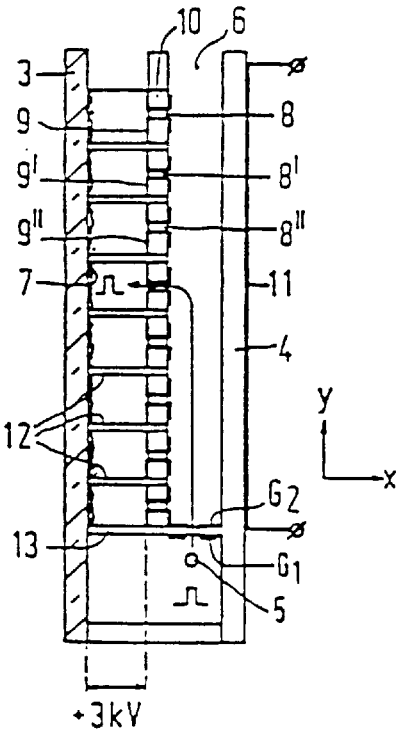
FIG. 1A is a side elevation, broken away, of the construction of FIG. 1 to illustrate the general operation of the invention.
Figure 1B:
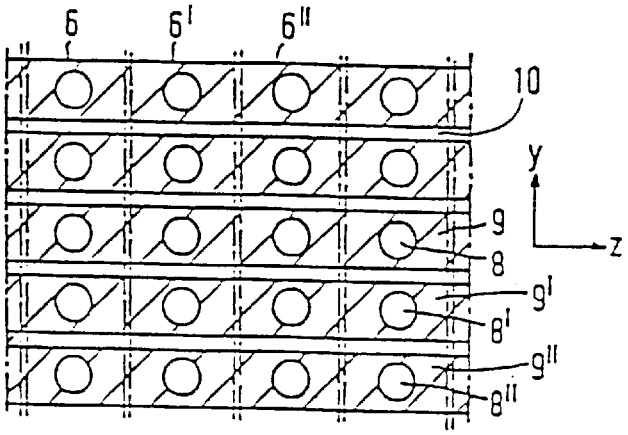
FIG. 1B shows a (selection) electrode arrangement to be used in the construction of FIG. 1.

FIGS. 1, 1A and 1B represent a flat-panel type picture display device 1 according to the invention having a front wall (window) 3 and a rear wall 4 located opposite said wall. An electron source arrangement 5, for example, a line cathode which by means of electrodes provides a large number of electron emitters, for example several hundred, or a similar number of separate emitters is present proximate to a wall 2 which connects front wall 3 and rear wall 4. Each of these emitters is to provide, for example a relatively small current so that many types of cathodes (cold or thermionic cathodes) are suitable as emitters. The emitters may be arranged jointly (cathode wire) or separately. They may have a constant or controllable emission. The electron source arrangement 5 is arranged opposite entrance apertures of a row of electron transport ducts extending substantially parallel to the screen, which ducts are constituted by compartments 6, 6', 6", . . . etc., in this case one compartment for each electron source. These compartments have cavities defined by walls. At least one wall (preferably the rear wall) of each compartment is made of a dielectric material which has a suitable electrical resistance for the purpose of the invention (for example, ceramic material, glass, or other synthetic material—coated or uncoated) and which have a secondary emission coefficient $\delta>1$ over a given range of primary electron energies (see FIG. 3). The electrical resistance of the wall material has such a value that a minimum possible total amount of current (preferably less than, for example, 10 mA) will flow in the walls in the case of a field strength ($E_y$) in the compartments on the order of one hundred to several hundred volts per cm, required for the electron transport. By applying a suitable voltage between the row 5 of electron sources and the walls of the compartments 6, 6', 6", electrons are accelerated from the electron sources towards the compartments, whereafter they impinge upon the walls in the compartments and generate secondary electrons.

The compartment walls closer to the luminescent screen 7, which is arranged on the inner wall of the panel 3, are constituted by a selection plate 10 (see FIG. 1A) in the embodiment according to FIG. 1. The selection plate 10 has extraction apertures 8, 8', 8", . . . etc. A "gating" structure proximate the extraction apertures can be used to "draw" a flow of electrons from a desired aperture in combination with emitters which are simultaneously driven. Preferably, individually driven emitters are used in combination with a plurality of apertured strip-shaped selection electrodes 9, 9', 9", . . . to be energized by applying selection voltages. These electrodes are present on the surface of the selection plate 10 facing the front wall 3 or the rear wall 4, or on both surfaces. In the latter case corresponding selection electrodes on opposite sides of the place 10 are preferably interconnected electrically via the apertures 8, 8', 8". The selection electrodes 9, 9', 9" . . . are implemented for each line, for example in the way shown in FIG. 1B ("horizontal" electrodes with apertures aligned with the apertures 8, 8', 8", . . . ). The apertures in the electrodes will generally be at least as large as the apertures 8, 8', 8", . . . If they are larger, aligning will be easier. Desired locations on the screen 7 can be addressed by means of (matrix) drive of the individual cathodes and the selection electrodes 9, 9', 9", . . . Voltages which increase (approximately linearly) with distance from the electron entrance areas) are applied to the selection electrodes 9, 9', 9", . . . When electrons must be withdrawn, via a selected row of apertures, from the electrons flowing in the ducts, a pulsatory voltage $\Delta U$ is added to the constant voltage applied to the respective selection electrode. In view of the fact that the electrons in the ducts have a relatively low velocity due to the collisions with the walls, $\Delta U$ may be comparatively low (on the order of, for example, 100 V to 200 V). The constant voltage difference V across the total compartment height is selected so as to not draw electrons from apertures at any height.

Figure 2A:
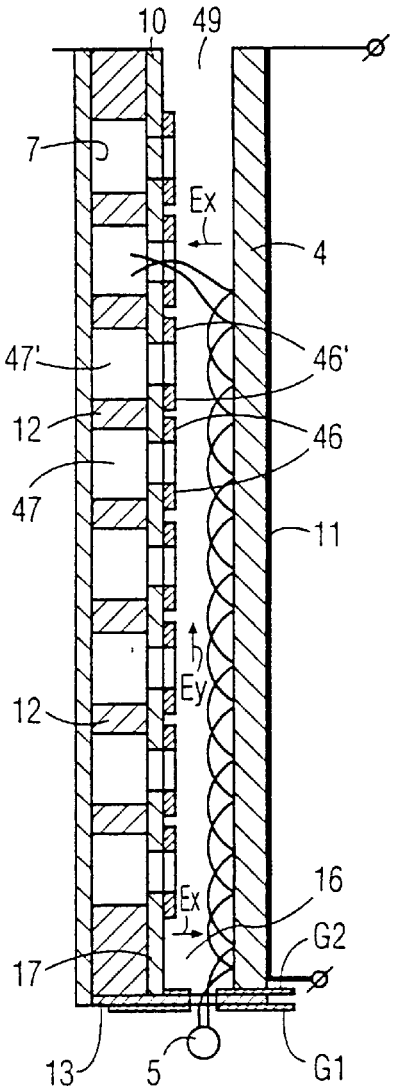
FIGS. 2A and 2B show the operation of a specific electron transport duct to be used in the construction of FIG. 1 with reference to a "vertical" cross-section and a voltage diagram.

The idea of transporting electrons via "hopping" across the rear wall 4 is illustrated in FIG. 2A. The "hopping" electrical phenomenon may arise when electrons impinge on the surface of rear wall 4 of insulating material in the presence of a longitudinal field $E_y$. A transverse field $E_x$ is generated upon charging of the surface. For a controlled charge (potential) distribution, a low-ohmic layer could be provided on the rear wall. However, this would require substantial power when operating the display. A more practical solution is to provide an internal high-ohmic resistance layer on the rear wall (not shown). The rear wall potential may be adjusted by applying a voltage across the high-ohmic resistance layer. Rows of apertured electrodes 46, 46', . . . are provided on the duct wall (selection plate) 10. These electrodes are given respective substantially linearly increasing potentials which are lower than the local potentials on the opposite portion of rear wall 4. In this way not only is an axial field component $E_y$ created, but also a transverse field component $E_x$. As long as no selection voltage is applied to one of the electrodes 46, 46', . . . , the component $E_x$ provides for a component, directed towards the rear wall 4, which inhibits electrons from acquiring high velocities. This improves the image contrast. In an entrance portion 16 of the electron duct 49 adjacent to the cathode 5 an entrance electrode 17 may be provided for generating a field upon energization, with which field the injected electrons are urged towards the rear wall 4.

Figure 8A:
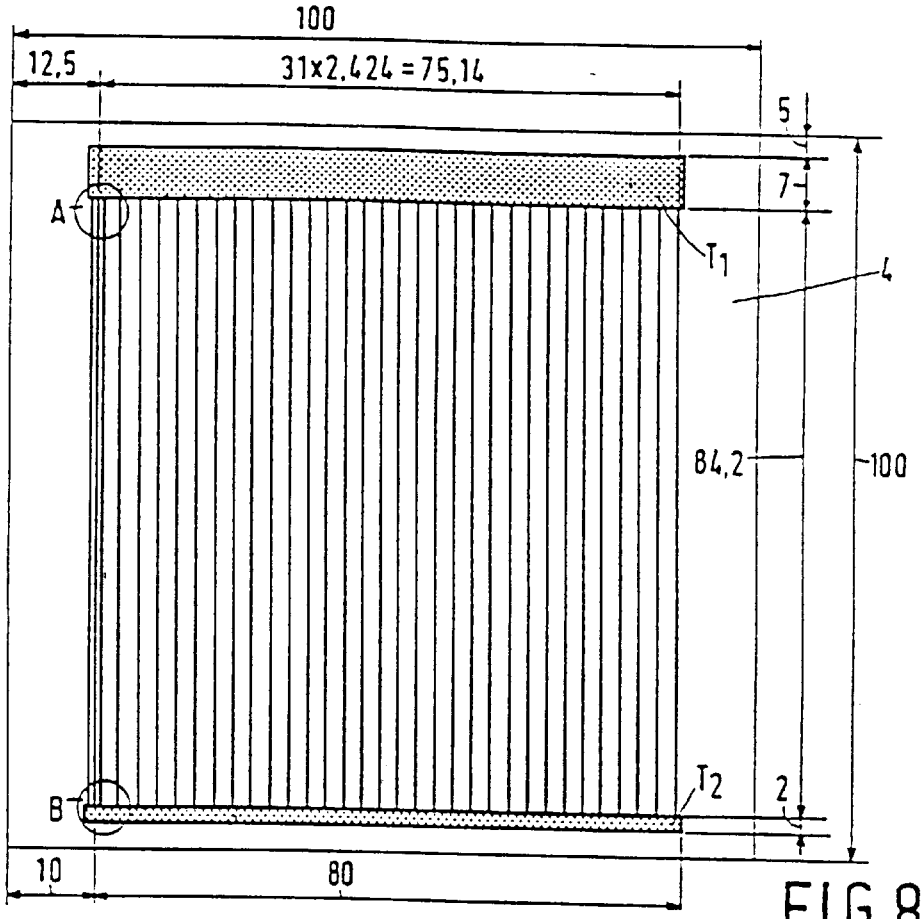
FIGS. 8A and 8B represent a resistance pattern for use on the rear wall of the transport ducts of a device according to the invention.
Figure 8B:
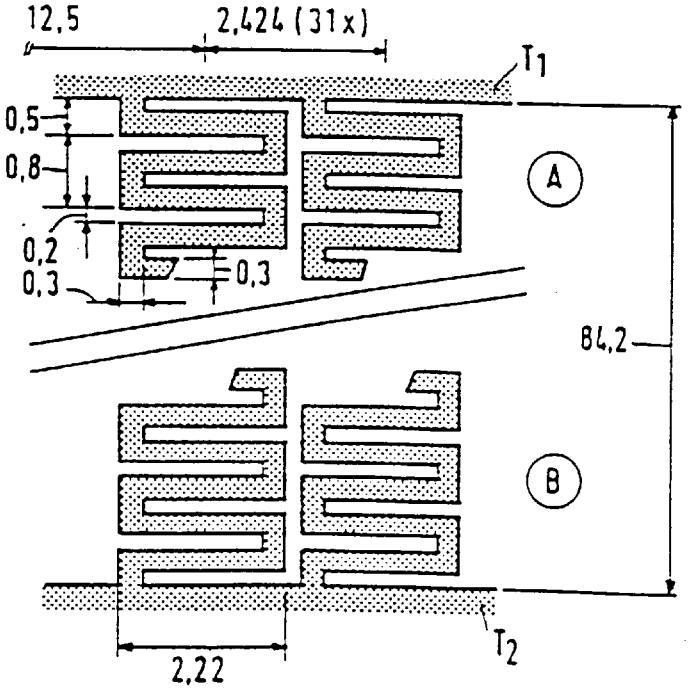

As shown in FIG. 8 the resistance layer on the rear wall may be provided with an input contact T2 at the entrance portion and with an output contact T1 at the (far) end of the transport duct. In early devices of the present type the potential at the input contact should be carefully adjusted so as to obtain a uniform brightness image. The potential at the output contact is less critical. In normal operation, the transport mechanism adjusts automatically, i.e. the wall charge on the insulating walls adapts itself (to a steady-state condition). However, when the display is switched on, and at moments after periods in which there has been no or little transport of electrons along a given location for a substantial period of time, a situation may occur in which the wall charge deviates from the steady-state condition in such a way that transport is hampered or impossible or starts with great difficulty. The following cases can be distinguished:

1. The potential at a distinct wall location is substantially lower than it should be. In this case all electrons are repelled and the self-stabilizing mechanism cannot be readily established. This condition thus inhibits effective operation of the display.
2. The potential is slightly too low or too high compared to what it should be. In this case transport is still possible and the steady-state condition will be rapidly established by adding or depleting an appropriate quantity of charge at the wall location where it is needed. In operation this may cause an error in the brightness at a pixel.
3. The potential is substantially higher than what it should be. In this case the electrons are automatically attracted towards the duct wall along which electron transport is effected. This condition will self correct relatively rapidly. The electrons required for correction will, of course, not contribute to screen excitation. Consequently, the light output at the affected pixels will be too low or even zero during correction.

The invention provides different embodiments for maintaining a steady-state electron transport condition.

In a first embodiment the output contact of the high-ohmic resistance layer is maintained, but the input contact is omitted. This is possible, provided that the resistance layer has a very high impedance and conducts a current which is very small in comparison with the transport currents required for the display. When the display is switched on, a potential difference is applied to the top and bottom ones of the selection electrodes for producing a transport field and the output contact of the resistance layer is set to an initiation potential which is at least as high as the potential applied for the transport field. The result is that the resistance layer is charged via electric conductance towards the output contact to a too high potential. In accordance with the above explanation under item 3, the transport starts rapidly if electrons are injected into the duct and the correct potential along the length of the duct is (automatically) adjusted.

In accordance with a second embodiment of the invention the resistance layer in the duct is omitted and replaced by another voltage distribution mechanism. A simple solution is the use of an insulating material such as glass or ceramic material for the rear wall itself. The side of the rear wall remote from the extraction apertures is now provided with a conductive means 11 (FIG. 2A) in the form, for example, of a (continuous) layer of indium-tin oxide (ITO). When the display is switched on, to this conductive means (or start-up conductor) a potential is applied which is as high as, or even higher than, the potential applied for transport. A practical choice is, for example the same potential as the output contact which is connected to an end electrode of the (selection) electrode means on selection plate 10. When the display is switched on, the potential at the inner side of the duct rear wall will be higher than is required for transport due to a very small conductance through the insulating material of the rear wall, or, in the case of an extremely low conductance, due to capacitive coupling. This potential is subsequently corrected rapidly by the mechanism described before under item 3.

During the display on the screen of a very dark image, the electron transport current supplied by the source 5 is very low. In this case the potential of the rear wall will drift upwards due to leakage current through the insulating material of the rear wall 4. Subsequently, when a lighter image is presented, the corresponding higher electron transport current causes the rear wall potential to stabilize at a lower value.

In addition to a reliable operation, as explained above, the start-up conductor embodiment has the advantage that accurate control of the potential is not necessary. The exact potential of the start-up conductor is not critical, as long as it is high enough to start transport of injected electrons. If a relatively slow start-up of the transport is not a problem the potential applied to the start-up conductor may be even lower than the potential applied for producing the transport field. What is essential is, that the start-up conductor makes that the rear wall is not negatively charged locally. Nor must the material of the conductive layer be as carefully chosen as the layer of the first embodiment which must have desired resistance, linearity, and secondary emission properties. Also, it is simpler to fabricate the ducts, as no resistance layer need to be applied on the bottoms of the ducts. Further, the conductive means functions as a shield against exterior electric fields which might adversely affect image presentation on the screen.

In accordance with a third embodiment, an improvement can be obtained by also forming the rear wall of an insulating material, but providing on the side remote from the extraction apertures a conductor means which facilitates the application of different potentials to different sections of the wall, instead of setting the conductor means on one and the same, much too high, potential. This embodiment has e.g. a plurality of parallel strips of readily electrically conductive material to which can be applied different potentials which comply with the potentials at the inside of the duct necessary for electron transport. An alternative is the provision of a resistive layer which "automatically" distributes the potentials along the real wall. If desired this layer may have a meandering pattern.

By applying a positive pulse voltage (selection voltage) of a sufficient value to a selected one of the electrodes 46, 46', . . . , the electrons are withdrawn from the ducts at these locations and transported towards the screen 7. At each of these locations the positive pulse voltages reverse the direction of the field $E_x$, as is shown in FIG. 2A. An open spacer structure, whose horizontal walls 12 are visible in FIG. 2A, may be arranged between the apertured wall of the ducts 49 and the screen 7. The apertured strip-shaped electrodes 46, 46', . . . may be provided in a relatively simple manner proximate to the apertures of this spacer structure. An alternative spacer structure is a plate having apertures which are coaxial with the apertures in the strip-shaped electrode 46, 46', . . . Instead of metal strips with apertures, strips of metal gauze may be used.

Figure 2B:
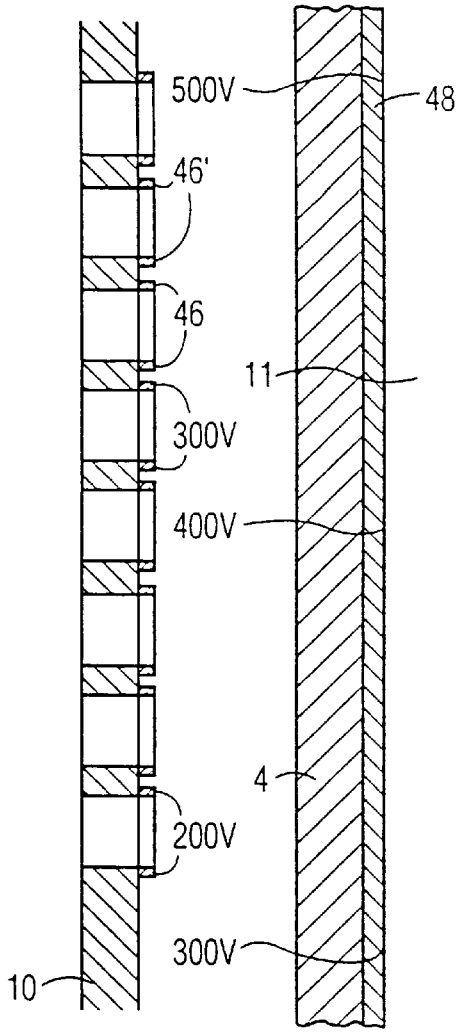

FIG. 2B shows a part of a duct rear wall 4 provided in this case with an external, high-ohmic resistance layer 48, while a plurality of apertured strip-shaped selection electrodes 46, 46', . . . are arranged on the opposite duct wall. In operation there is in this example a voltage difference of 200 V between the upper portion and the lower portion of the shown part of the rear wall 4. The high-ohmic resistance layer 48 ensures that the voltage distribution along the rear wall is well defined. The same voltage difference of 200 V is present from the upper one to the lower one of the group of selection electrodes 46, 46', . . . facing the shown part of the rear wall 4, but the selection electrodes have lower voltages (100 V lower voltage in this case) than respective opposite portions of the rear wall. For example, by applying to the selection electrode which is at the 300 V potential such a voltage pulse that the voltage sufficiently exceeds the voltage on the opposite part of the rear wall, the electrons "hopping" along the rear wall can be drawn out at the location of the corresponding aperture of the selection electrode in question.

It is noted that in the case that there is no voltage difference applied across the layer 48, or if this layer is absent, a potential distribution will be produced along the rear wall, which on an average is linearly increasing, if the voltages on the selection electrodes are switched on. This effect is due to capacitive transfer. However, if there is a slight deviation from the average trend, the start-up of the electron transport may be hampered. To guarantee start-up of the transport in all situations the invention provides a start-up conductor means.

The following exemplary method of manufacturing high-ohmic resistance layers suitable for the purpose of the invention may be used: A glass plate is coated with an adhering homogeneous powder layer comprising a mixture of glass enamel particles and $RuO_x$ particles or similar particles. This powder layer may be given a meandering configuration, for example by means of scratching the layer or selective deposition by silk-screening or photolithography. Subsequently the glass plate with the powder layer is heated until the resistance layer has reached the desired resistance value. Values of the resistance per square on the order of MOhms can be realised in this manner. In a practical display of the relevant type a resistance of $10^7$ to $10^{10}$ Ohm measured between the upper end and the lower end of the layer on the rear wall may be realised in this manner. An alternative method is to provide a thin, layer of a semiconductor material such as, for example $In_2O_3$, $SnO_x$, indium-tin oxide (ITO) or antimony-tin oxide (ATO). The desired resistance values in the height direction of the resistance layer can then also be obtained. Such a resistance layer may also be used on a surface of the apertured wall 10 as a voltage divider to which the selection electrodes are connected.

Figure 3:
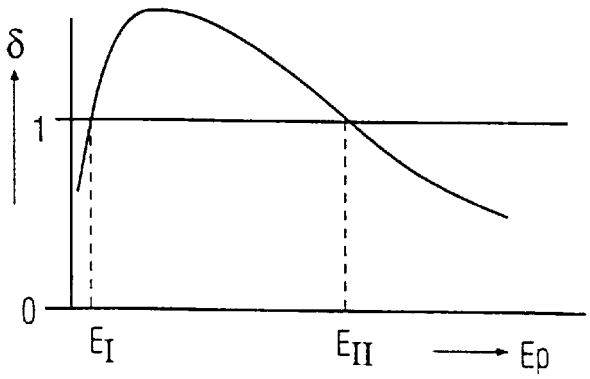
FIG. 3 shows a graph in which the secondary emission coefficient δ as a function of the primary electron energy $E_p$ is plotted for a wall material which is characteristic of the invention.

The electrically insulating materials to be used for the walls of the electron ducts must preferably have a secondary emission coefficient $\delta>1$, see FIG. 3, at least over a certain range $E_I$–$E_{II}$, of primary electron energies $E_p$.$E_p$ is preferably as low as possible, for example, one or several times 10 eV. Inter alia, specific types of glass (having an $E_I$ of approximately 30 eV) and ceramic materials meet this requirement. Materials which do not meet this requirement may be provided with a coating which does meet the secondary emission requirement, like e.g. MgO.

From a construction point of view the duct walls may consist of an electrically insulating material which has a constructive function as well as a secondary emission function. Alternatively, they may consist of an electrically insulating material having a constructive function (for example, a synthetic material like KAPTON ®), on which material a layer which is a good secondary electron emitter (low $E_I$) is provided (for example, quartz or glass or ceramic material such as MgO). It has been found that for achieving symmetrical transport conditions in the ducts it is advisable, if layers of secondary emitting materials are used, to provide these layers at least on the bottom wall and on both side walls.

The electric voltage between the upper and lower ends of the electron ducts required for electron transport increases with the length of the ducts. However, this voltage can be reduced by arranging a line of electron sources adjacent the center instead of at the end of the ducts (as in FIG. 1). A voltage difference of, for example 3 kV can then be applied between the center of each duct and its top so as to draw "up" the electron current from the center to the top end and subsequently, the same voltage difference can be applied between the center and the bottom end so as to draw the electron current "down" from the center to a bottom end, instead of applying a voltage difference of 6 kV throughout the height when the electron sources are arranged on the "bottom" of the display device. The use of a plurality of parallel rows of electron sources even more reduces the transport voltage.

Electrons which are drawn from an aperture in an electron duct by a selection electrode are directed towards the luminescent screen 7 where one picture line at a time can thus be written. The video information may be applied, for example, in the form of pulse width modulation. For example, an emitter cooperating with an electron duct can be energized by pulses of a modulated time duration. When using the "hop" mode described with reference to FIGS. 2A and 2B, the number of electrons which can reach large velocities is limited because the electrons are subjected to an electrostatic force which drives them towards the rear wall.

In the electron ducts the electrons acquire velocities which at the instant of collision with a wall approximately correspond to an energy of 30 eV, which is equal to the energy where the secondary emission coefficient is 1. Electrons which enter electron duct 11 with a larger energy, viz. an energy equal to the G2 potential (which is larger than 30 eV) may undergo elastic back-scattering, whereby they can pass through unaddressed extraction apertures and influence the image contrast if they reach the screen.

Figure 4:
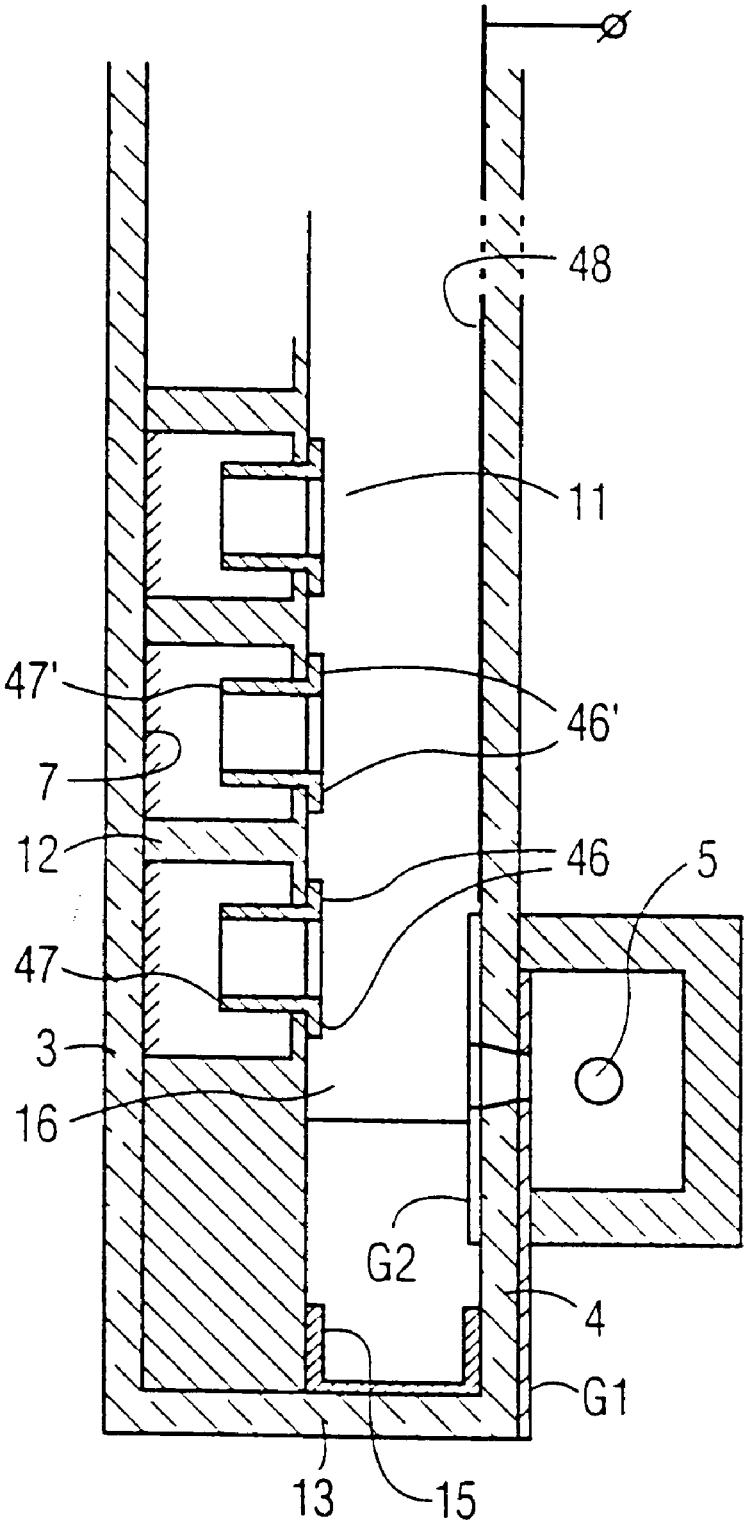
FIG. 4 is a "vertical" cross-section through a part of a construction which is an alternative to the construction of FIG. 1A.

As has been shown in FIG. 4, electrons emitted by cathode 5 may enter entrance portion 16 of an electron duct through an aperture in the duct rear wall 4 at a location where said wall opposes cathode 5. The emission is controlled by means of electrodes G1 and G2. This construction makes it difficult for the emitted electrons to travel in the longitudinal direction of the duct at high velocities. It is a further insight the invention is based on that transport start-up problems may be caused to a certain extent by the presence of residual gases. Gases may be adsorbed on the walls, especially during the time that there are no electron currents present, lowering the secondary emission value $\delta$. To lower the local pressure of residual gases such as $O_2$, $H_2O$, carbon containing gases, a getter material 15 is provided on the bottom wall 13 and the adjacent side wall portions of the ducts. The deposition of the getter material may be carried out by heating a getter material containing wire (one at the bottom section, one at the top section of the vacuum envelope, and preferably one adjacent the cathode; wires not being shown in the drawing). Preferably a getter material is also provided on, or adjacent, the top wall of the ducts.

Velocity restriction configurations can be created in various other manners, for example by arranging the configuration of drive electrodes $G_1$ and $G_2$ in a duct with an oblique wall portion (not shown) in such a way and/or by energizing them in such a way that electrons emitted by the cathode 5 into the entrance portion 16 always impinge upon a wall. Another possibility is to arrange the configuration of cathode 5 and drive electrodes $G_1$ and $G_2$ such that electrons emitted by the cathode propagate into the entrance portion 16 at an angle with respect to a longitudinal axis. Entrance portion is herein understood to mean in particular a portion of an electron duct which is not provided with extraction apertures.

Figure 7:
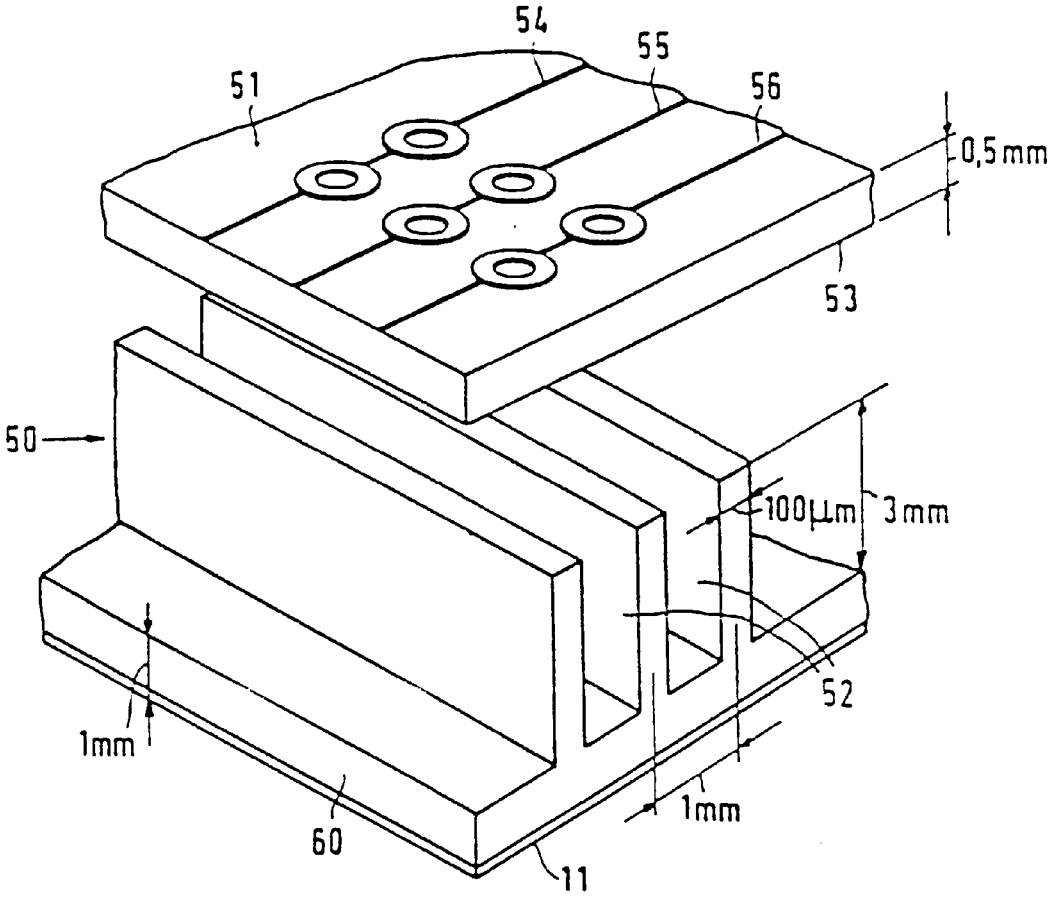
FIG. 7 shows diagrammatically an alternative structure of a display device according to the invention.

By arranging the start conductor means on the outer surface of the rear wall, a display device in accordance with the invention may have a simple structure. In particular the walls between the ducts may be formed as parts of the rear wall, instead of being separately manufactured partitions. In other words: the ducts are formed by channels provided in the rear wall substrate. FIG. 7 shows an example of a part of such a structure. The Figure shows a duct defining profiled plate 50 whose profiled surface faces an apertured selection plate 51. Some dimensions are shown in the Figure by way of example. The plates 50 and 51 may be made of, for example, a ceramic material or glass, while the desired profiled form can be provided during manufacture in the case of plate 50. (This is possible, because if a start-up conductor means is provided on the outer surface of plate 59 no special layer need to be provided on the inner surfaces of plate 50 defining ducts.) To realize a plate with "integral" ducts, the plate material may be mixed with a binder in a finely divided form and injection-moulded, whereafter the binder is heated and sintered. An alternative method is to manufacture the plates via a sol gel process. To this end, for example, $SiO_2$ gels may be caused to solidify in a mould. A sintering operation is carried out subsequent to release from the mould and drying. The ducts may alternatively be formed by pressing grooves in the plate 50 while the material it is in a softened condition (e.g. by rolling) etching grooves in a flat plate or making grooves in a flat plate by means of an erosion process (powder blasting).

The electron transport ducts are formed in the spaces 52 between the upstanding edges of the plate 50. Electrons can be withdrawn from the ducts and transported directly, or via further transport ducts to a luminescent screen by means of the selection plate 51, which is provided with extraction apertures which can be driven via addressing or selection tracks 54, 55, 56 of electrically conducting material.

The transport through the ducts determines the quality of the luminescent image displayed or the screen and the operating efficiency to a considerable extent. For example, the image contrast is determined largely by the number of electrons which leave the ducts via unselected extracting aperture during transport and by the efficiency with which the electrons are extracted from the ducts. The width-height ratio is also important in this respect. A ratio of ⅔ or ratio's which do not differ more than 25% from ⅔ are preferred. Moreover, a great part of the electrical power utilized by the display device is dissipated in effecting the transport of electron in the ducts by means of transport fields.

To minimize power usage and to maximize voltage stability, it is desirable to maintain the transport voltage (the voltage difference between the input end and the output end of the duct) as low as possible. If the transport voltage is made too low, however, on the one hand the number of electrons leaving the duct via unselected extracted aperture may become large enough to cause contrast deterioration. On the other hand too low of a transport voltage may give rise to instabilities in transport, causing an unsteady flickering image to be displayed on the screen.

FIG. 5 is a diagrammatic cross-section of a part of the display device of the type shown in FIG. 1, particularly including an active addressing structure 100 which comprises a preselection plate 10*a* with extraction apertures 8, 8', 8", . . . and a fine-selection plate 10*c* with groups of colour selection apertures R, G, B. For example, one set of three or two sets of three fine-selection apertures R, G, B may be associated with each extraction aperture 8, 8', etc.. Other arrangements are alternatively possible. To facilitate the explanation, in the diagrammatic FIG. 5 the apertures R, G, B are shown to lie on one line. However, in practical embodiments they will generally be located in a triangular configuration. Preferably, an anti-direct-hit plate 10*b* having apertures 108 is arranged between the preselection plate 10*a* and the fine-selection plate 10*c*, which anti-direct hit plate constitutes obstructions ("chicanes") in the electron paths.

Each of the electron transport ducts 6 is confined between the structure 100 and the rear wall 4. To enable withdrawal of electrons from the transport ducts 6 via the apertures 8, 8', . . . , apertured metal preselection electrodes 9, 9', etc. are arranged on the plate 10*a* (by means of a metallization process).

The walls of the apertures 8, 8', . . . may (also) be metallized. Preferably, there is little or no electrode material on the electron-transport-duct side of plate 10*a*, to ensure that the selection electrodes minimally collect electrons i.e. the electrodes 9, 9', . . . do not draw current.

Another way to prevent drawing current is to manufacture, in the case that there is substantial electrode metal on the duct sided selection plate surface (where the electrons land) the electrode 9, 9', . . . from a material having such a large secondary emission coefficient that they do not draw any net current.

Similarly as the plate 10*a*, the fine-selection plate 10*c* is provided with addressable rows of (fine-) selection electrodes 13, 13', 13" for realising fine selection. The possibility of capacitively interconnecting corresponding rows of fine-selection electrodes (for example, via coupling capacitors: referred to as AC interconnection) is important in this respect. Because preselection has already been performed by selecting a preselection electrode 9, 9', . . . a plurality of, or all, corresponding fine selection electrodes can be selected as one group, to complete selection of the respective areas of the screen 7 to be excited by extracted electrons.

In one exemplary manner of powering the display, the rows of preselection electrodes are subjected to a linearly increasing DC voltage by connecting them to a resistive voltage divider. This divider may be arranged at the edge of the preselection plate, in vacuo, and electrically connected to rows of the preselection electrodes. The resistive voltage divider is connected to a voltage source in such a way that the preselection electrodes receive the correct potential to realise electron transport in the ducts. Due to the presence of the chicane, or anti-direct hit, plate 10*b*, the rows of fine-selection electrodes can be subjected to the same DC bias voltage, in one group or in a number of groups.

Let it be assumed that the colour selection system is arranged and operated to divide the image are in triplets which each comprise a Red, a Green and a Blue pixel. For selecting a triplet a pulse of, for example 250 V, is applied to a preselection row electrode for 60 $\mu$s and, during this pulse pulses of, for example 200 V, are applied sequentially to the desired fine-selection electrodes for 20 $\mu$s. It should of course be ensured that the selection pulses are in synchronism with the video information. The video information is applied, for example, to the $G_1$ electrodes (see FIG. 1A) in the form of an amplitude (or time) modulated signal.

To ensure that none or a negligibly small number of the electrons land at (unselected screen area) (the wrong location), which would be at the expense of contrast and colour purity, the apertured chicane or anti-direct hit plate 10*b* of electrically insulating material is arranged between the preselection plate 10*a* and the (fine-)selection plate 10*c*. Each aperture 108 in the anti-direct hit plate 10*b* corresponds to an aperture in the preselection plate 10*a* (FIG. 2).

The size of the apertures in this anti-direct hit plate (for example, diameter 0.35 mm) and the distance between the anti-direct hit plate and the fine-selection plate (for example, 0.25 mm) are preferably chosen to be such that the electrons cannot or cannot travel in a straight line from the preselection apertures towards the apertures in the fine-selection plate. A great advantage is that, in principle, a great many, if not all, fine-selection electrodes can be interconnected per group (for example, per colour), which is referred to as DC interconnection. The reason is that the edge of each aperture in the anti-direct hit plate approximately assumes the potential of the oppositely located part of the fine-selection plate.

However, this means that the entire transport voltage (plus the voltage required for fine-selection in the transport mode) is present at one side of the display over the distance between preselection plate and anti-direct hit plate; therefore, this distance should not be chosen to be too small and is preferably larger than approximately 0.4 mm.

DC interconnection of all fine-selection electrodes has the additional advantage that a post-acceleration voltage applied to the luminescent screen may be the same throughout the display, thus precluding any variation in brightness along the screen in the (longitudinal) direction of the transport ducts. This is particularly important when using larger screen formats in which the cathodes are preferably arranged centrally.

A further improvement can be achieved by associating electron collection electrodes 14, 14', . . . with each aperture 108 in the plate 10*b* in the space between the plate 10*b* and the plate 10*c*. These collection electrodes, which may be arranged, for example, on the plate 10*b* or on the plate 10*c* and may be, for example strip-shaped and connected row by row to a voltage source D2 (FIG. 6), ensure that unwanted electrons which still pass through the plate 10*b* (referred to as "high hop" electrons) are attracted to the collection electrodes 14 so that they cannot reach the luminescent screen. To realise this, it is advantageous to ensure that the (horizontal) ducts formed between the preselection plate and the fine-selection plate are always in the transport mode by giving the fine-selection electrodes and the electron collection electrodes a positive voltage with respect to the preselection electrodes. The electron collection electrodes of the non-addressed colour pixels are brought to a higher voltage than the adjacent fine-selection electrodes. This guarantees a perfect contrast because "high hop" electrons cannot reach the luminescent screen but are attracted by the electron collection electrodes. When a colour pixel is being addressed, the respective fine-selection electrode is brought to a higher voltage than the corresponding electron collection electrode.

Since only a few (for example, 3 or 6) connections and coupling capacitors are required for the fine selection in this way, it is possible to increase the amplitude of the pulses at these electrodes to, for example 400 V. This provides another advantage: the same potential may be applied to all the electron collection electrodes, for example 100 V above the DC voltage of the fine-selection electrodes. This means that the assembly of electron collection electrodes may be formed, for example as a metal spacer, which simplifies construction. Otherwise, the option remains that such high-value pulses are not applied to the fine-selection electrode, but then the electron collection electrodes have to be driven separately (the number of electron collection electrodes is equal to or smaller than the number of preselection electrodes) and should be given negative pulses.

Considerations which are comparable to those as regards the transport in the transport ducts apply to the transport through the apertures of the chicane plate. When the display is switched on, the potential should be approximately as high as, or higher than the ultimate transport potential. This can be ensured by arranging a "start" electrode pattern on the chicane plate and applying thereto an initial potential which is higher than the potential applied for transport. In complete analogy with the start-up conductor means on the rear wall of the transport ducts, this yields a more reliable operation.

In an advantageous embodiment the chicane start-up electrode pattern is the same as the electron collection electrode pattern (FIG. 6) which must be present anyway somewhere in the space in front of the fine-selection apertures. Necessarily, the potential of the electron collection electrodes is slightly higher than the transport potential in the chicane aperture and is thus very suitable for applying a suitable starting potential condition in the chicane aperture via capacitive coupling and possibly via some conductance by the chicane plate. The exact geometry of the electron collection electrode may be chosen to be such that the potential distribution generated by the capacitive coupling and/or conductance optimally suits the potential distribution required for transport in the chicane aperture and the space between the preselection and chicane plate. A combination of electron collection electrode pattern and "start" electrode pattern on the chicane plate may be advantageous in this case.

It is the insight the invention is based on, that the conductance of the various components of the display should be either very high or very low with respect to the normal emission currents. Otherwise, the display would operate essentially differently in the case of light and dark scenes.

In the displays described hereinbefore the electron transport through the ducts takes place via hopping along the rear wall. A resistance layer may be provided on the inner or outer surface of the rear wall of the ducts. A potential difference is applied across this resistance layer so that electrons hop in the direction of increasing potential. The resistance layer may be given a meandering shape so as to achieve a sufficiently high resistance value, the meander extending throughout the width of the display. If the meandering resistance layer is provided on the inner surface of the ducts, horizontal crosstalk between the ducts may occur because the rear wall potential opposite an addressed picture line locally increases as a result of the electron transport and because the resistance of the meander is low in the horizontal direction. This becomes manifest, inter alia in loss of contrast, for example to such an extent that a black picture area situated next to a bright picture area is no longer perfectly black. This loss of contrast can be avoided by providing a strip of resistance material in the longitudinal direction of the ducts for each duct separately. By meandering this strip, the total resistance can be adjusted with the shape of the meander in combination with the resistance per square of the material. Since compared with a continuous resistance layer, the resistance in the horizontal direction is some magnitudes larger in this embodiment (due to the surface resistance of the rear wall material glass) there will be no horizontal crosstalk between the ducts.

FIG. 8 shows an embodiment of a rear wall having a plurality of meander strips arranged in parallel and extending between two terminals T1 and T2, the resistance values being approximately $13.5\times10^{9}\Omega$ per strip at the sizes indicated (in mm) in the case of ruthenium oxide meander strips. The resistance per square of the ruthenium oxide used is approximately $10^{7}\Omega$cm.

The operation of the present display is based on electron transport along the surface of insulators (the vacuum current is far larger than the current through the insulators). A condition for stationary transport is that as many electrons should land everywhere as there should leave, or in other words, the average secondary emission coefficient is equal to 1 throughout ($\delta=1$ condition). The secondary emission coefficient is determined by the velocity with which the electrons land; the latter is determined, inter alia, by the potential. If a change is introduced in a given state, such as, for example when a selection electrode is "switched on" or when it is switched over, the potential will generally have to change so as to comply with the $\delta=1$ condition in the new situation. This means that charge on the walls of the system changes. This charge is added to or withdrawn from the electron current, as will be explained hereinafter.

Figure 9A:
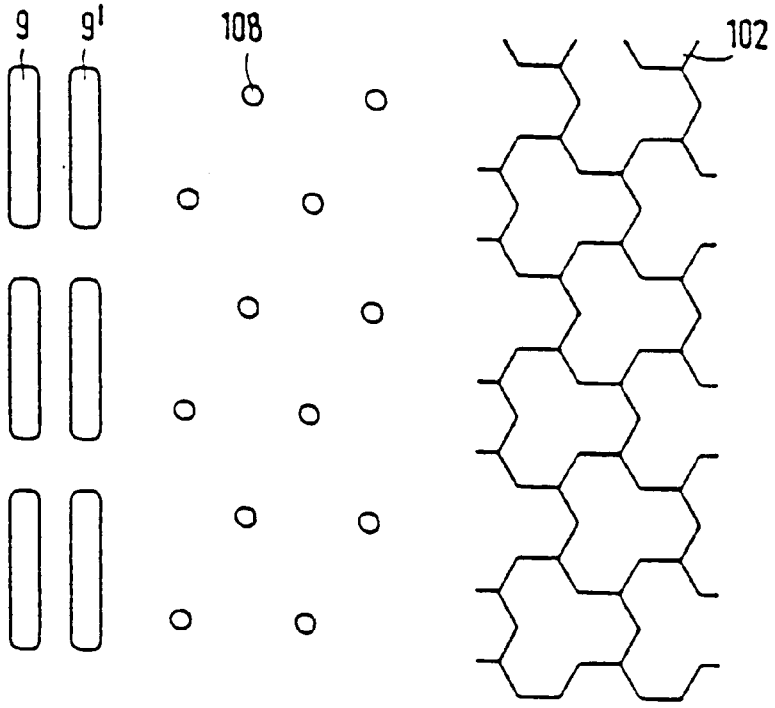
FIGS. 9A and 9B show diagrammatically the aperture arrangements of plates 10*a*, 103 and 10*b* of FIG. 5, separately and together, respectively.
Figure 9B:
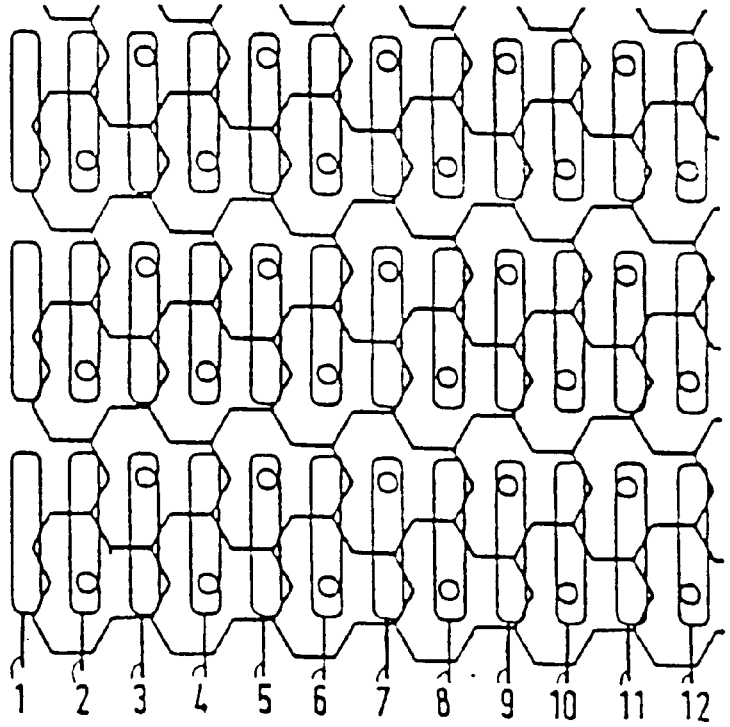
Figure 10:
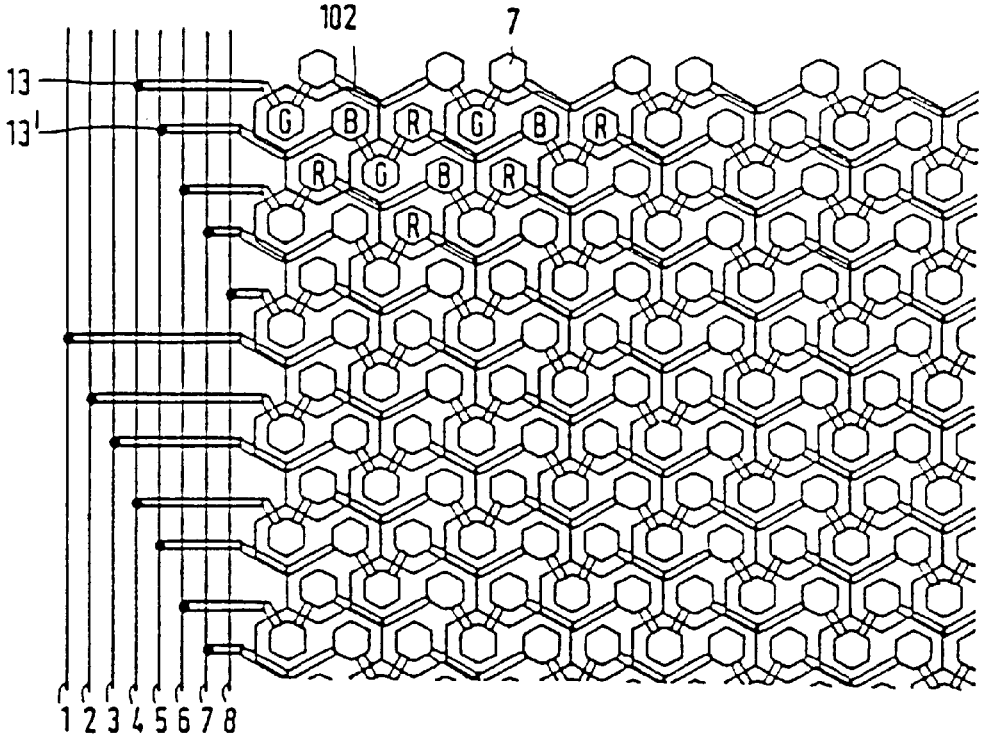
FIG. 10 shows diagrammatically the aperture arrangement of the plate 102, in alignment with the phosphor dot pattern 7 and the fine selection electrode pattern 13,13' of FIG. 5.

FIGS. 9A, 9B and 10 show a part of the display structure of the type as shown in FIG. 5. FIGS. 9A and 9B show the preselection apertures 9, 9', the chicane apertures 108 and the chicane spacer 102 separately and after assembly respectively. FIG. 10 shows the chicane spacer 102 together with the metallisation pattern 13, 13' of the fine selection. The way in which the fine-selection electrodes are interconnected is also shown (in this example there are 8 main selection electrodes; however, the latter is not essential for the effects described here. A satisfactory alternative is, for example 6 main selection electrodes). An addressing scheme is shown in Table 1. Upon addressing, the phosphor screen is given an arrangement of triplets each comprising red, green and blue. In the sequence shown in Table 1 the arrangement given (for one duct) is the same as that shown in FIG. 11A. The image information is written per triplet in the sequence shown.

TABLE 1

Figure 11A:
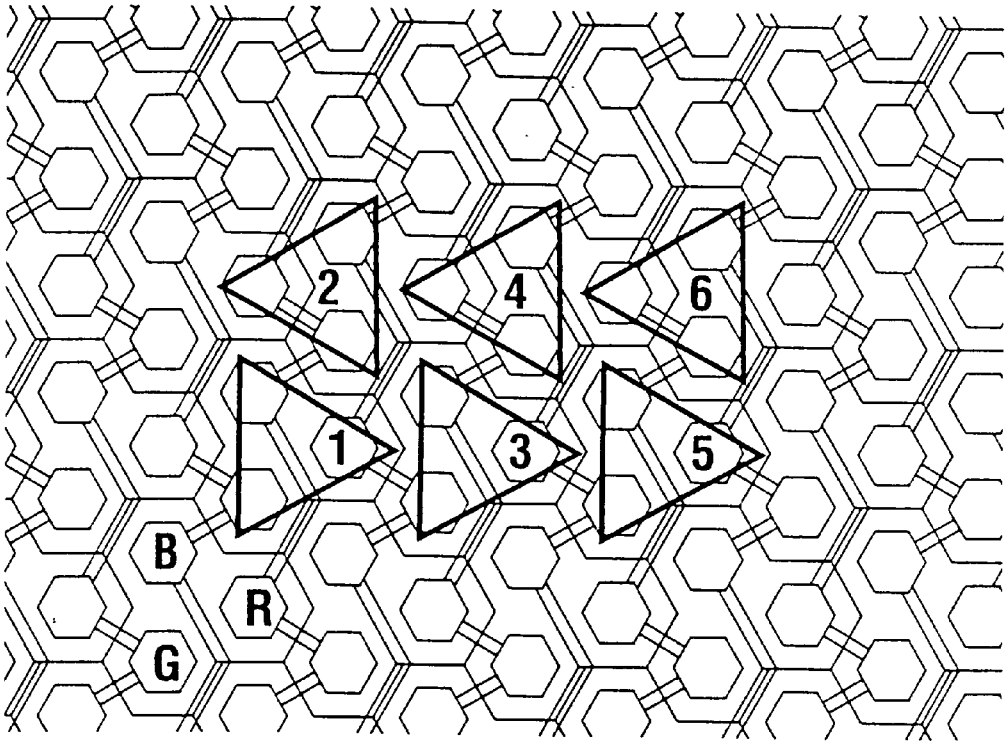
FIGS. 11A and 11B show two alternative driving sequences for the phosphor dot triplets of FIG. 10.

(Compare FIG. 11A)

| Preselection | Fine selection | Colour |
|---|---|---|
| 5 | 2 | R |
| 5 | 8 | G |
| 5 | 1 | B |
| 4(!) | 1 | R |
| 6 | 1 | G |
| 6 | 2 | B |
| 7 | 4 | R |
| 7 | 2 | G |
| 7 | 3 | B |
| 6(!) | 3 | R |
| 8 | 3 | G |
| 8 | 4 | B |
| etc. | etc. | etc. |

Upon addressing by means of applying a preselection signal to a distinct preselection electrode, positive charge is built up on the rear walls of the ducts. Generally, the average scan direction (sequence of applying preselection signals) is opposed to the transport direction. In row 4 of Table 1 the preselection sequence takes a step back: i.e. the preselection sequence is non-monotonously increasing or decreasing. This means that the electrons reach their destination via the positive charge of the previous addressing. The "neutralisation" of this charge is at the expense of the current and yields a relatively darker pixel. (In row 7 of Table 1 the positive charge need not be neutralised first and the intensity is "normal".)

A remedy for this "charge transfer" is an operation referred to as "resetting". When all preselection electrodes are in the off-state, the system can be reset by passing sufficient current through the ducts, so that the initial transport condition is restored. In this case the resetting operation is performed at the image frequency. As this is a low frequency, the resetting operation performed periodically in this way (by supplying reset pulses) takes a relatively short time and a low power. Old addressing charge is depleted in this way. The resetting operation should in any case be performed when the preselection sequence takes a step back. To have a reproducible starting position, it is preferred to reset at every change of the preselection. Resetting seems to be absolutely adequate for the addressing scheme of Table 1 if it is done for every single pixel, i.e. each row in Table 1. However, this is a costly affair. It is time-consuming, which is at the expense of the time available for cathode control, and it takes power, which involves relatively large currents being passed through the entire duct.

Figure 11B:
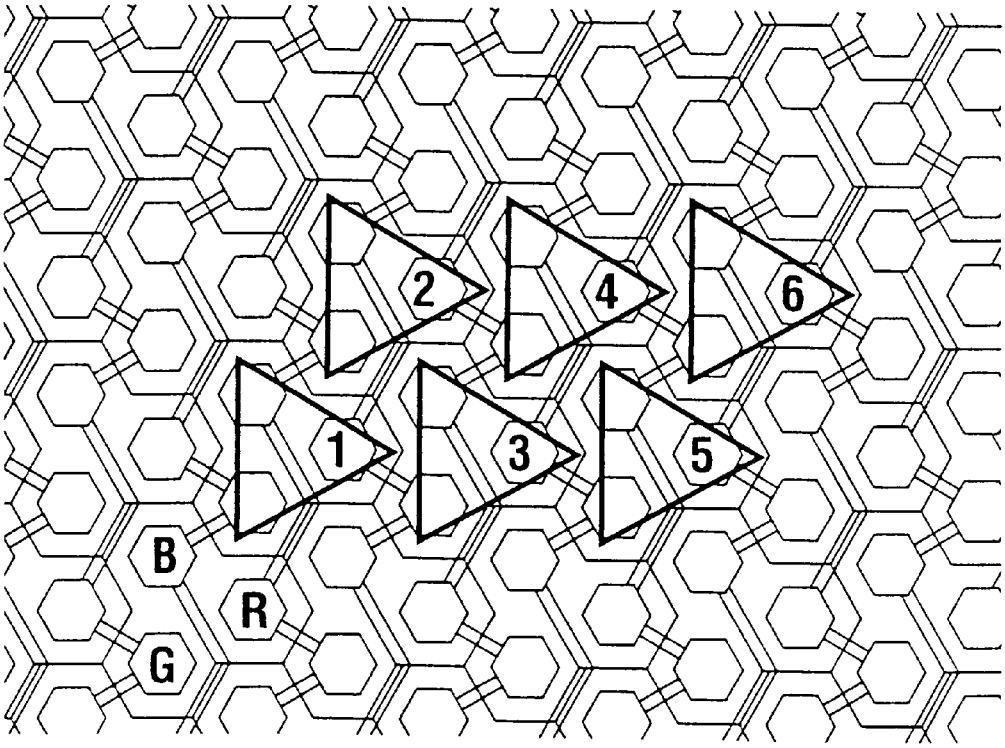

An alternative and simpler remedy is to have the preselection always move in one direction (i.e. the preselection order is monotonously increasing or decreasing: no stepping back), so prevent it from reciprocating within an image. Table 2 shows an addressing scheme in which this is the case. The image can now be considered to be composed of triplets as shown in FIG. 11B. In this case the triplets register with the chicane spacer in a natural way. In principle, the colours within a triplet can be addressed in an arbitrary sequence.

TABLE 2

(Compare FIG. 11B)

| Preselection | Fine selection | Colour |
|---|---|---|
| 5 | 8 | G |
| 5 | 1 | B |
| 5 | 2 | R |
| 6 | 1 | G |
| 6 | 2 | B |
| 6 | 3 | R |
| 7 | 2 | G |
| 7 | 3 | B |
| 7 | 4 | R |
| 8 | 3 | G |
| 8 | 4 | B |
| 8 | 5 | R |
| etc. | etc. | etc. |

The resetting process at image frequency described hereinbefore with reference to the non-monotonous preselection sequence can be also of advantage in the case of monotonous preselection sequence, in particular in the case that the scan direction is opposite to the transport direction (as in that case in the beginning of the scanning the rear wall frequently does not have the required charge condition).

Figure 12:
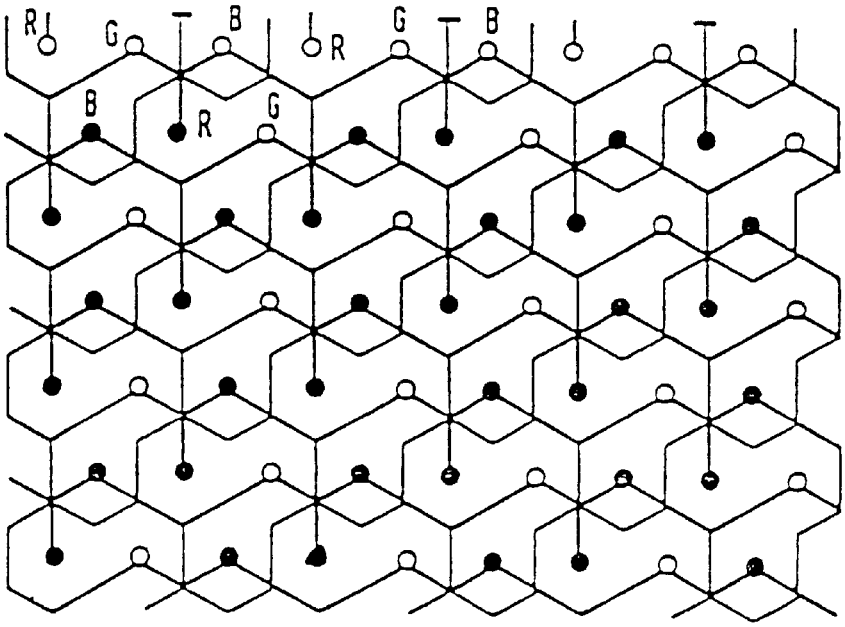
FIG. 12 shows an alternative selection electrode pattern.

The fine selection may also involve charge transfer causing deviations in colour intensity of the image. It has been found that these effects are suppressed to a substantial extent if the metallisation patterns (the fine-selection electrode patterns) per aperture in the chicane spacer (i.e. per triplet) are substantially equal. This is the case in FIG. 10. The pattern shown in FIG. 12 also meets this requirement.

We claim:

1. A picture display device having a vacuum envelope which is provided with a transparent face plate with a luminescent screen for displaying pictures composed of pixels, which display device comprises a plurality of sources for emitting electrons, electron transport ducts cooperating with the sources and having walls of a dielectric material for transporting secondary electrons, initiated by wall interactions with the emitted electrons in a longitudinal direction past openings in the ducts at a short distance from the luminescent screen, and means for accelerating the electrons from said openings and toward the luminescent screen, characterized in that the transport ducts have a width/height ratio which does not differ more than 25% from ⅔.

2. A picture display device having a vacuum envelope which is provided with electron transport ducts cooperating with sources for emitting electrons and means for extracting electrons from the electron ducts, characterized in that the transport ducts have a width/height ratio which does not differ more than 25% from ⅔.

* * * * *